United States Patent [19]

Ezzell et al.

[11] 4,273,626

[45] Jun. 16, 1981

[54] ELECTROLYTE SERIES FLOW IN ELECTROLYTIC CHLOR-ALKALI CELLS

[75] Inventors: Bobby R. Ezzell; Marius W. Sorenson, both of Lake Jackson, Tex.

[73] Assignee: The Dow Chemical Company, Midland, Mich.

[21] Appl. No.: 80,814

[22] Filed: Oct. 1, 1979

Related U.S. Application Data

[62] Division of Ser. No. 924,268, Jul. 13, 1978, Pat. No. 4,197,179.

[51] Int. Cl.[3] ..... C25B 1/34; C25B 1/02

[52] U.S. Cl. ..... 204/98; 204/128; 204/129

[58] Field of Search ..... 204/98, 128, 301, 252, 204/129

[56] References Cited

U.S. PATENT DOCUMENTS

| | | | |
|---|---|---|---|
| 2,694,680 | 11/1954 | Katz et al. | 204/301 X |
| 4,057,474 | 11/1977 | Kurtz et al. | 204/98 |
| 4,133,730 | 1/1979 | DuBois et al. | 204/98 |
| 4,146,438 | 3/1979 | DeNora et al. | 204/98 X |

*Primary Examiner*—R. L. Andrews
*Attorney, Agent, or Firm*—W. J. Lee

[57] ABSTRACT

In an electrolytic chlor-alkali cell, or bank of cells, having a plurality of electrolyte compartments containing electrode pairs (anodes and cathodes) and wherein a hydraulically-impermeable membrane separates the electrolyte compartments into catholyte portions and anolyte portions, said cell or cells being employed to produce chlorine at the anodes and caustic and hydrogen at the cathodes by the electrolysis of an aqueous alkali metal chloride electrolyte, improved operation is attained by flowing anolyte liquor from anolyte portion to anolyte portion, sequentially, while simultaneously, and in the opposite direction, flowing catholyte liquor from catholyte portion to catholyte portion, sequentially. The membrane substantially prevents Cl⁻ from entering the catholyte liquor from the anolyte, and a high purity caustic, substantially free of salt, is produced.

13 Claims, 4 Drawing Figures

ELECTROLYTE SERIES FLOW IN ELECTROLYTIC CHLOR-ALKALI CELLS

CROSS-REFERENCE TO RELATED APPLICATION

This is a division of application Ser. No. 924,268, filed July 13, 1978, now U.S. Pat. No. 4,197,179.

BACKGROUND OF THE INVENTION

The electrolytic production of chlorine and caustic by the electrolysis of brine has been well known for many years. Historically, diaphragm cells using a hydraulically-permeable asbestos diaphragm, vacuum-deposited onto foraminous steel cathodes, have been widely commercialized. Such diaphragm cells, employing permeable diaphragms, produce NaCl-containing NaOH catholytes because NaCl passes through the diaphragm from the anolyte to the catholyte. Such NaCl-containing caustic generally requires a de-salting process to obtain a low-salt caustic for industrial purposes.

In recent years, the chlor-alkali industry has focused much of its attention on developing membrane cells to produce low-salt or salt-free caustic in order to improve quality and avoid the costly de-salting processes. Membranes have been developed for that purpose which are substantially hydraulically-impermeable, but which will permit hydrated $Na^+$ ions to be transported from the anolyte portion to the catholyte portions, while substantially preventing transport of $Cl^-$ ions. Such cells are operated by flowing a brine solution into the anolyte portion and by providing salt-free water to the catholyte portion to serve as the caustic medium. Hydrogen is evolved from the cathode, and chlorine from the anode, regardless of whether a membrane cell or a diaphragm cell is employed.

As early as 1918, various patents have suggested the flow of electrolytes from one cell to another, in sequence. For instance U.S. Pat. No. 1,284,618 teaches and claims an apparatus wherein the catholyte liquor flows from cell to cell, gaining in caustic strength in each succeeding cell. By so doing, the average caustic concentration across all the cells is less than in the final cell; this permits greater caustic efficiency throughout the cells. The patent also teaches that the anolyte may also flow from cell to cell, either in the same direction as the catholyte series flow or in the opposite direction. The patent teaches that there is some percolation of cell liquor through the diaphragm, but postulates that the catholyte series flow would be even more advantageous if the diaphragm was impervious to hydraulic flow between the anolyte and catholyte. According to the patent, it is immaterial whether or not the anolyte is fed separately or in parallel, or fed in series with the catholyte. The patent teaches that the "spent" anolyte from the final cell of a series can be fed to the catholyte portion to serve as the catholyte liquor in which the concentration of caustic is incrementally increased through the series flow. The "spent" anolyte, however, is known to still contain a substantial amount of salt.

It is well known that caustic efficiency depends on, and is generally inversely related to, the caustic concentration of the catholyte in membrane cells and diaphragm cells. It has been reported (44th Annual Conference, Water Pollution Control Federation, San Francisco, Calif., Oct. 3–8, 1971, page 12—paper by S. A. Michalek et al, Ionics, Inc.) that caustic efficiency does not substantially depend on the salt concentration (salt utilization) of the anolyte. It is also reported there that the membrane employed was "an XR cation-transfer membrane" and that the anode was a "DSA" anode supplied by Electrode Corporation. It is believed that "an XR cation-transfer membrane" refers to Nafion ® developed by E. I. du Pont de Nemours as an electrolytic membrane and that "DSA" refers to a dimensionally-stable anode comprising a titanium substrate coated with a layer of ruthenium oxide. The article discloses (page 9) that " - - - the most economical and practical design was a simple two compartment membrane cell with independent water feed to the cathode." The cell is used in electrolyzing aqueous NaCl to produce $H_2$ and NaOH at the cathode and $Cl_2$ at the anode; then the so-formed NaOH and $Cl_2$ is reacted to make sodium hypochlorite which is used in sewage treatment.

It is an object of the present invention to produce a highly pure aqueous caustic solution by the electrolysis of alkali metal halide.

Another object is to provide a process whereby the overall efficiency of a chlor-alkali electrolytic membrane cell, or bank of cells, is improved.

A further object is to provide a process whereby the alkali metal chloride in the anolyte of a chlor-alkali electrolytic cell is more efficiently used without a significant loss of caustic efficiency.

Still another object is to provide an electrolytic cell which is capable of operating for extended periods of time without suffering a substantial loss of current efficiency or undergoing a rapid rate of wear.

SUMMARY OF THE INVENTION

An electrolytic chlor-alkali membrane cell, or bank of cells, is provided whereby an aqueous alkali metal chloride is electrolyzed to produce caustic, hydrogen, and chlorine, said cell, or bank of cells, comprising a plurality of electrolyte compartments containing electrode pairs (anodes and cathodes) said electrolyte compartments being separated by hydraulically-impermeable membranes situated between electrode pairs so as to provide anolyte portions and catholyte portions, with electrical circuitry provided for supplying current to each cell with means for series flowing of anolyte liquor from anolyte portion to anolyte portion, sequentially, in a given direction and means for series flowing of catholyte liquid in the opposite direction from catholyte portion to catholyte portion, with means for removing hydrogen from the catholyte portions and for removing chlorine from the anolyte portions, with means for feeding an alkali metal chloride brine as anolyte liquor to the first anolyte portion in the anolyte flow sequence and means for removing spent anolyte liquor from the last anolyte portion in the anolyte flow sequence, and with means for feeding water as catholyte liquor to the first catholyte portion in the catholyte flow sequence and means for removing caustic-enriched catholyte liquor from the last catholyte portion in the catholyte flow sequence.

Preferably the cathodes are comprised of ferrous metal coated with a porous nickel layer to provide low-overvoltage cathodes and the anodes are dimensionally stable metal anodes comprised of an electrically-conductive substrate coated with an electrically-conductive protective coating of a noble metal, an insoluble oxide of a metal of the platinum group, or an insoluble spinel of cobalt.

DETAILED DESCRIPTION OF THE INVENTION

Figure 1:
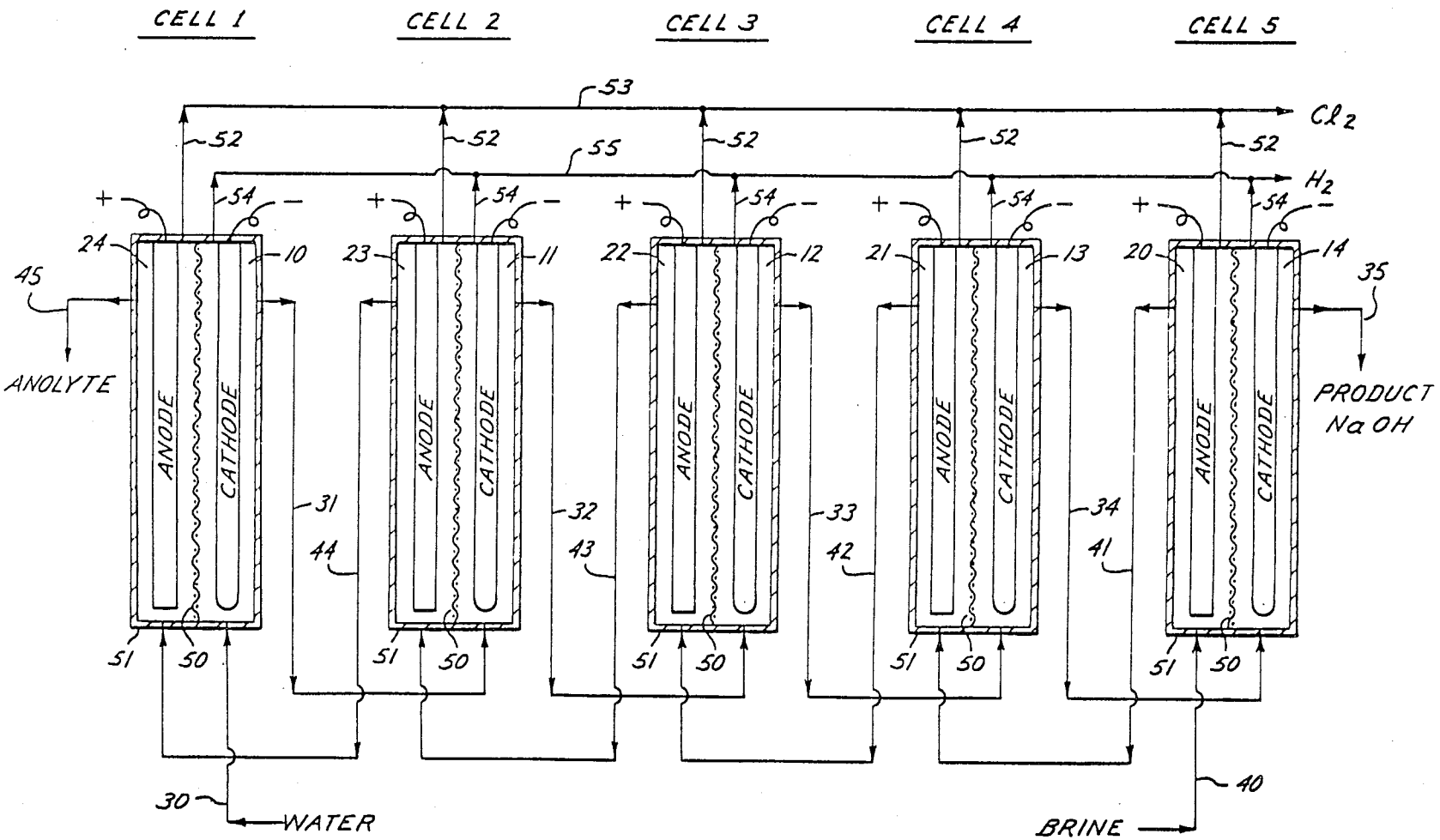

FIG. 1 illustrates or depicts the principal features, not drawn to scale, of an embodiment to provide a graphical or visual aid in the description of the invention.

Figure 2:
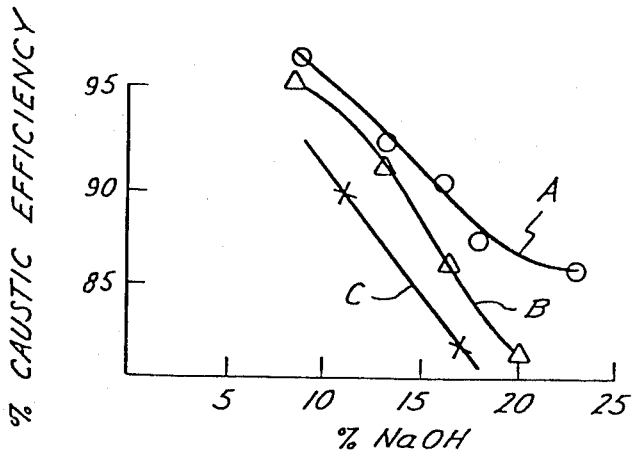
Figure 3:
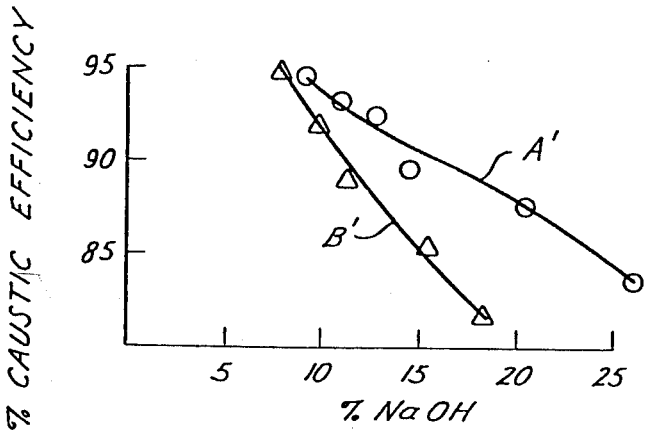
Figure 4:
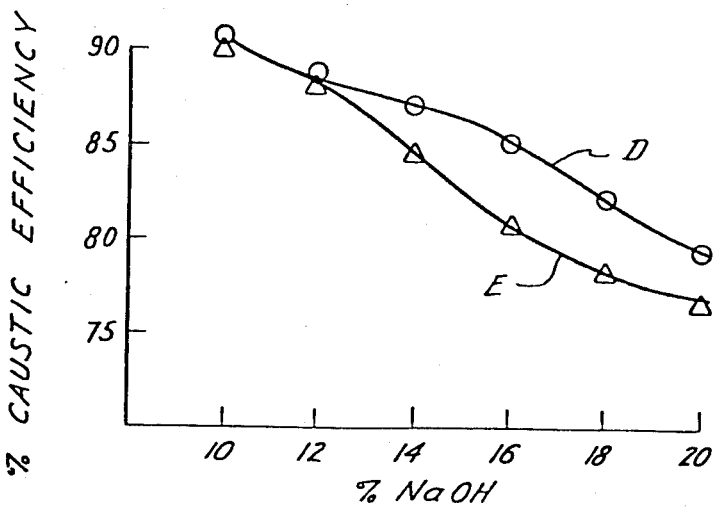

FIGS. 2, 3, and 4 are graphs depicting data curves of experimental comparisons to aid in describing the invention.

In FIG. 1 there are shown five cells in a series. It is not essential that there be five, as there may be more or less than five, though a plurality of electrode pairs arranged in series are required. A plurality of electrode pairs may be contained within a single multi-cell body, with the plurality of catholyte portions communicating, sequentially, by appropriate flow means and the plurality of anolyte portions communicating, sequentially, by flow means. For purposes of conciseness, such plurality of electrode pairs within a single multi-cell body are not depicted here, though in some instances may be a preferred embodiment. Also not depicted here, for purposes of conciseness, a plurality of anodes within a given anolyte portion and a plurality of cathodes within a given catholyte portion may be used and, in some instances, may be a preferred embodiment.

In FIG. 1 there are cells 1, 2, 3, 4, and 5, each cell comprising a body (51) divided into anolyte portions (20–24) and catholyte portions (10–14) by a hydraulically-impermeable membrane (50). Within each anolyte portion there is an anode and within each catholyte portion there is a cathode. The cells are provided with electrical circuitry to provide current for either bipolar or monopolar operation.

During operation the anolyte liquor of each cell is provided by flowing a concentrated aqueous alkali metal chloride solution (40) into the lower part of anolyte portion (20) and out through flow means (41) from the upper part of (20) into the lower part of anolyte portion (21). In like manner, the anolyte liquor flows sequentially through each anolyte portion (21), (22), (23), and (24) through flow means (42), (43), and (44) until it is removed from the last anolyte portion (24) by flow means (45) as a partially-depleted, or "spent", alkali metal chloride solution.

The catholyte liquor of each cell is provided, in counter-current manner, by flowing water (30) into the lower part of catholyte portion (10) and out through flow means (31) into the lower part of catholyte portion (11). The catholyte liquor accrues caustic strength as it flows sequentially through the series of catholyte portions (10), (11), (12), (13), and (14) through flow means (31), (32), (33), and (34) and leaves (14) at (35) as a relatively concentrated caustic solution.

It will be understood that the cell liquor flow into and out of a given electrolyte portion does not have to be in an upward manner for operability, but it is preferred, for best operation, that the flow be upward, especially because of the gas-lift effect of the evolved gas. Chlorine gas evolves upwardly in the anolyte portions and hydrogen gas evolves upwardly in the catholyte portions. The chlorine gas leaving the upper part of the anolyte portions is conveyed through flow means (52) and is collected in a header (53) for recovery. The hydrogen gas leaving the upper part of the catholyte portions through flow means (54) is collected in a header (55) for recovery. A flow of cell liquor downwardly would tend to prevent, to some extent, proper mixing of the feed with the electrolyte portion already present in the cell.

The alkali metal chloride employed in the anolyte may be NaCl or KCl.

The membrane employed is one which is referred to as "hydraulically-impermeable" though it is generally recognized in the art that membranes having slight permeability to water may be used in some instances; for instance, the sodium ion that is transported is hydrated. Such membranes are usually thin and may sometimes be prepared by sintering, or melting together, of particulate materials. Sometimes the membranes have small pin-holes or minute passageways or imperfections through which some water can traverse. The membranes may be of, or contain, materials which impart cation exchange capabilities or may even be of a non-ion-exchange material. Microporous sheets, where the principle means of transport is electroosmotic, may be employed. In particular, membranes prepared from fluoropolymers, such as polymers or copolymers of vinylidene fluoride, chlorotrifluoroethylene, tetrafluoroethylene, hexafluoropropylene, perfluoro (alkyl vinyl ether), and the like are considered to be within the purview of the present invention. Also in particular, a membrane material developed by E. I. duPont and known in the art as Nafion®, is especially suitable. This material is a hydrolyzed copolymer of tetrafluoroethylene and a sulfonated perfluorovinyl ether having the formula $$F-SO_2-CF_2CF_2O\underset{\underset{CF_3}{|}}{C}FCF_2OCF=CF_2,$$

such as are disclosed in U.S. Pat. No. 3,282,875.

As used herein, the term "membrane" is employed to mean a thin sheet of material which is impermeable, or substantially impermeable, to the hydraulic flow of water, and which will allow passage of hydrated $Na^+$ from the anolyte to the catholyte while substantially preventing the passage of $Cl^-$ from anolyte to catholyte. To practitioners of the relevant arts the term "diaphragm", in contradistinction to "membranes", usually refers to materials which permit the hydraulic passage of anolyte to the catholyte portion, such as asbestos diaphragms.

The anodes may be any electroconductive substance (e.g. graphite, platinum, etc.) which will withstand the corrosive environment in the cells for significant lengths of time without undergoing substantial losses of conductivity. Graphite anodes are subject to erosion and loss of dimensions, however, and platinum metal anodes are very expensive. Therefore, the preferred anodes comprise relatively inexpensive, conductive substrates having protective coatings of conductive, stable metal oxides or mixtures of metal oxides. Particularly preferred are dimensionally stable anodes comprising a substrate of a valve metal, also called film-forming metal, such as titanium, having a protective coating of a platinum metal oxide (such as in U.S. Pat. No. 3,711,385 and U.S. Pat. No. 3,776,834) or a protective coating of a cobalt spinel (such as in U.S. Pat. No. 4,061,549 and U.S. Pat. No. 3,977,958).

The cathode may be any electroconductive material which will withstand the environment in the cell for appreciable lengths of time without substantial loss of conductivity or of dimension. Historically, steel or iron cathodes have been widely employed, but in recent years improved cathodes have been developed which comprise ferrous substrates coated with porous Ni, such as in U.S. Pat. No. 4,024,044 and German Pat. No. 2,527,386. Such porous Ni coatings are useful in reducing the cathode overvoltage.

The invention, then, provides a means of improving the efficiency of a chlorine cell, or bank of cells, that uses a hydraulically-impermeable or slightly permeable membrane as the separator. When an ion exchange membrane, such as du Pont's Nafion® is used in a chlorine cell, the efficiency depends upon the specific properties of the particular membrane, the caustic strength in the catholyte and the sodium chloride concentration of the anolyte. Membranes that function particularly well at preventing the back migration of hydroxide ions from the catholyte to the anolyte, and as such result in good caustic and chlorine efficiencies, generally operate at higher cell voltages than less ion selective membranes (e.g., amine treated Nafion vs. untreated; 1100 eq. wt. Nafion vs. higher eq. wts.).

In a conventional membrane process, water is added continuously to the catholyte compartment of the cell. The rate of this water addition, along with the rate of water from hydrated sodium ions passing through the membrane from the anolyte compartment, determines the caustic strength of the catholyte compartment. Brine is added continuously to the anolyte compartment. The rate of this addition determines the anolyte concentration. At a given anolyte and catholyte concentration, the efficiency becomes largely a function of the particular membrane used. For better prevention of hydroxide ion migration, membranes that are swelled by water to lesser relative degrees are used. This can be accomplished by chemically crosslinking the polymer material used to make the membrane, increasing the equivalent weight of the functional polymer or by using different ion exchange groups in the polymer. In general, decreasing the water content of a polymer material increases the electrical resistance and leads to higher cell voltage. Voltage can be decreased by decreasing the thickness of a given membrane, but this can lead to a reduction in permselectivity of the membrane. At a given catholyte and anolyte concentration, the overall efficiency, based on the membrane, becomes a trade-off between voltage and chlorine and caustic efficiency. Migration of hydroxide ions into the anolyte compartment results in increased pH and, as a result, increased oxygen formation on the anode. Chlorate formation increases at increasing pH of the anolyte. Both of these phenomena lead to decreased chlorine efficiency; thus, the relationship between chlorine efficiency and caustic efficiency. It is possible, and well known in chlorine cell operation, to offset the loss in chlorine efficiency from loss in caustic efficiency by lowering the pH of the anolyte by addition of acid, preferably hydrochloric acid, to the anolyte compartment of the cell. This can be accomplished by direct addition to the cell or by addition to the brine feed of the anode compartment. Cost is, of course, incurred from acid addition. When acid is added to the anolyte compartment, in a conventional membrane process, the trade-off in overall cell efficiency then becomes one between voltage and caustic efficiency.

It is well known that caustic efficiency depends on the caustic concentration of the catholyte for both membrane and diaphragm chlorine cells. It has been reported (44th Annual Conf. Water Pollution Control Federation, San Francisco, Calif., Oct. 3–8, 1971, page 12—paper by S. A. Michalek et al Ionics, Incorporated) that caustic efficiency does not substantially depend on the salt concentration of the anolyte. Hence high conversions (80%) of the salt feed is reported to be desirable. When Nafion® membrane is used, our results show that the above report is correct at the lower caustic concentrations (2–2.85 N) discussed in the report. However, our results show in addition, that at higher caustic concentrations, anolyte concentration does substantially effect caustic efficiency. Above about 10–12% caustic, higher anolyte concentration results in higher caustic efficiency. In a conventional membrane process brine, usually saturated, is continuously added to the anolyte compartment of the cell and anolyte is removed from the anolyte compartment at a rate dependent upon the rate of brine addition. The rate of the brine addition, then, determines the anolyte concentration. The higher the concentration, the more anolyte removal required. Removed anolyte is normally degassed, resaturated with sodium chloride, treated to prevent buildup of undesirable materials and returned to the cell. Thus, higher anolyte concentration requires that more anolyte be treated as described above. Generally, a trade-off would be reached, when operating above about 10–12% caustic, between efficiency gained by increased anolyte concentration and the amount of spent anolyte to be treated.

In a conventional process, each cell is individually fed a set rate of brine and a set rate of water. Thus, each cell operates with the same anolyte concentration and the same catholyte concentration. All trade-offs reached between caustic efficiency and voltage and caustic efficiency and anolyte concentration hold true for each cell. In such a method, spent anolyte from any number of cells is pooled for treatment of the composite. The caustic product from each cell is also pooled so that in the end there is only one caustic stream and one anolyte stream.

The present invention involves a different method of cell feed for both the water for the catholyte and brine for the anolyte. It has been discovered that changing the feed process allows a surprisingly and dramatic shift in the trade-offs involved in the conventional process. The new feed method involves dividing the cells into blocks or series consisting of two or more cells. Each block then, rather than each cell, is fed a stream of water and a stream of brine. The technique can well be called "series cell feed".

This new method of cell feed is based on a combination of two principles. One, that the efficiency of a cell is dependent on the caustic concentration of the catholyte. The principle of series feed of the catholyte liquors was first taught in U.S. Pat. No. 1,284,618 (to H. H. Dow). This patent teaches that, by series feed of the catholyte overflow of one cell to another cell and so on, the average caustic concentration of the cells as a group is lower than these cells operated individually. Hence, the overall efficiency is higher. The patent states that the invention does not in any way depend upon the derivation of the catholyte liquor from the anode compartment of the cells. It further states that the greatest efficiency from the feed technique would be achieved in the case where the diaphragm percolation was wholly eliminated. These conditions are met when membranes replace percolation diaphragms in chlorine cells. The second principle involved in the present invention is, as shown by our results, that the caustic efficiency is dependent on anolyte concentration, particularly when the concentration of the catholyte exceeds about 10–12% caustic. The patent also teaches that it is immaterial how the anolyte chambers of the cells are maintained. It is taught that they may be fed separately, in parallel, or in series and that if fed in series, the direction of flow, parallel or opposite to the catholyte flow, does not matter.

Our results, showing that at higher caustic strengths, higher anolyte concentration improves efficiency, demonstrates that the direction of flow in series feed is important. It has now been found that, when series feed (also called "cascade") of catholyte is used, series feed of the anolyte in a direction opposite to the catholyte flow provides surprising benefits. Using this feed direction, the cells operating at higher caustic concentrations in the catholyte are the cells that have the higher anolyte concentrations. It has also been found that even when catholyte cascade is not used, but rather each cell is fed individually, that cascade of the anolyte will still be surprisingly beneficial. The preferred embodiment is cascade of both anolyte and catholyte countercurrently. A more detailed description of the operating process follows.

Water is added to the catholyte compartment of the first cell in the block or series at a rate rapid enough so that only very dilute caustic is formed in this cell. The dilute caustic effluent from this first cell is then, by proper piping (flow means), fed to the catholyte compartment of the second cell where the concentration is slightly increased. The caustic effluent from this second cell then becomes feed for a third cell where caustic concentration is again slightly increased. This series flow is continued through the entire cell block until leaving the block at the last cell. The concentration of the final caustic solution and of each cell is dependent on the rate of water fed to the first cell. Using this method of feed each cell operates with a different caustic concentration of the catholyte. The number of cells in this block is only limited to the size of pipe (flow means) necessary to accommodate the increasing flow rate associated with increasing the number of cells in the block. The size of the flow means is limited to that which can be adequately attached in the space allowed by cell size. Operating in this block fashion, only one cell in the block (the last cell) is operating at as high a caustic strength as the product stream. All other cells are operating at progressively lower caustic strengths. Since, as was previously stated, caustic and chlorine efficiency is increased by decreasing caustic strength, the block of cells operating by this feed method operates at higher chlorine and caustic efficiencies than an equal number of cells operating at the same net caustic strength, but using the conventional single cell feed process. The total theoretical amount of product (chlorine and caustic) from the same number of cells operated by either feed technique is the same since this only depends on the amperage of the cell operation. The total voltage of the operation is essentially unchanged from that of the conventional process when the same membrane is used in both processes. Thus, when the same membrane is used, the gain in efficiency from the series feed process is realized as increased caustic and chlorine efficiency. It is possible, by use of the series feed process to realize the efficiency gain as voltage savings by using a different membrane than used in the comparative conventional process. If a membrane is used that has a higher water content (such as, by changing from 1500 eq. wt. Nafion to 1200 eq. wt. Nafion) the lower caustic and chlorine efficiency associated with this type membrane can be increased by the present invention while the lower voltage associated with this type membrane is maintained.

In addition to series feed to the catholyte compartments of the cells in the block, series feed of the anolyte is also desirable. This is most beneficial when done countercurrently to the catholyte stream. In the series feed concept, saturated brine is added to the last cell of the block at a rate that allows only slight depletion of the sodium chloride in that cell. The slightly depleted anolyte from the last is fed by proper flow means to the anolyte compartment of the next to the last cell where it is slightly further depleted. This series flow is continued from cell to cell until a desired depletion is reached. At this point, spent anolyte is removed and treated by the same process used in the conventional process. The number of cells connected by the series feed of anolyte may be, but is not necessarily, the same number as used in the block for catholyte series feed. It is possible to feed and withdraw spent anolyte from more than one cell in the block. Since the flow of anolyte may in many cases exceed the flow of catholyte, it may be desirable to feed saturated brine to more than one cell of the block. Again, the number of cells involved in the anolyte series feed is limited only by necessary flow means size restricted by cell size.

Use of the anolyte series feed results in higher caustic and chlorine efficiency when operating with a final catholyte caustic concentration in the region where increased anolyte strength results in increased caustic and chlorine efficiency. By having the series feeds operated countercurrently, the cells having the higher caustic strengths in the catholyte are the same cells that have the higher anolyte strengths. Once the point at or about 10% caustic, when Nafion® is used in the block of cells, is reached where caustic and chlorine efficiency no longer are substantially effected by anolyte concentration, further brine depletion is possible at little or no expense in efficiency. Thus, an increase in overall brine depletion at little or no expense is possible with series anolyte feed.

Thus, chlorine cells using ion exchange membranes or any type membrane where the flux through the membrane is primarily due to electroosmotic forces, can be operated at higher overall efficiency by use of countercurrent series flow of anolyte and catholyte. Higher brine conversion can be achieved by this process without attendant loss in efficiency. If it is desired to lower anolyte pH and consequently increase chlorine efficiency by addition of acid to incoming brine, countercurrent series feed enables the cells at lower chlorine efficiency to preferentially receive this acid. If catholyte series feed is used without anolyte series feed but rather single brine cell feed, either separate metering systems for incoming acid would have to be used for each cell or cells requiring little or no acid would receive the same acid as those requiring larger amounts of acid. Too much acid can lead to decreased caustic efficiency by transport of protons through the membrane from the anolyte compartment to the catholyte compartment.

In addition to the combination of anolyte and catholyte series feed, series feed of anolyte alone that is in combination with single cell feed of catholyte would increase caustic and chlorine efficiency at a given brine conversion. This would allow all but the last cell in the series to operate with a higher anolyte concentration than a single cell operation at the same brine conversion.

EXPERIMENTAL

(FIG. 2)

For purposes of illustration, a single-cell operation, a catholyte-cascade operation, and a counter-current cascade (anolyte and catholyte) are compared as to the effect of caustic concentration on caustic efficiency at a given NaCl concentration in the anolyte.

FIG. 2 depicts data showing that counter-current cascade (curve A) has higher caustic efficiency at a given caustic concentration than catholyte-cascade (curve B) or single-cell operation (curve C). In all three instances, the brine feed is 25% NaCl, the catholyte concentration is varied by varying water feed rate, brine conversion is about 45%, and anolyte overflow is about 18% NaCl.

In the single-cell operation (curve C), 25% NaCl brine is fed to, and anolyte containing 18% NaCl is withdrawn from, the anolyte portion of a single-cell chlor-alkali cell equipped with a woven wire-mesh steel cathode, a dimensionally-stable metal anode, and a Nafion ® membrane. By "single-cell operation" it is meant that anolyte flows through only one anolyte portion and catholyte flows through only one catholyte portion; it is representative of membrane cells wherein anolyte from a common source is fed to each of several anolyte portions simultaneously and wherein water is fed to each of several catholyte portions simultaneously.

In the catholyte-cascade operation (curve B), 25% NaCl brine is simultaneously fed to, and anolyte containing 18% NaCl withdrawn from, each of five anolyte portions and water is fed to the first cell of the five corresponding catholyte portions from whence it flows, sequentially, through each of the four remaining catholyte portions, accruing caustic strength as it flows from cell to cell.

In the counter-current operation (curve A), 25% NaCl brine is fed to the anolyte portion of the last cell of the 5-cell series from whence it flows sequentially through the four other cells until it leaves the first cell as "spent" anolyte containing 18% NaCl; simultaneously, water is fed to the first catholyte portion from whence it flows, counter-currently to the anolyte flow, through the four other cells until it leaves the last cell enriched with caustic.

In all three operations (A, B, and C) the inter-electrode gap is about 0.3 cm, the membranes being deposed between anodes and cathodes and having a thickness of about 0.02 cm. The cells are operated at a current density of about 150 mA/cm$^2$, the temperature is about 80° C. and the cell voltage average is about 3.1 volts. The brine is regulated at a rate to obtain about 18% NaCl in the anolyte overflow and the catholyte flow is regulated to achieve the various caustic concentrations in the catholyte effluent. Caustic efficiency is determined by weighing the caustic actually produced and comparing that to the theoretical amount possible.

EXPERIMENTAL

(FIG. 3)

In similar manner to curves A and B in FIG. 2, curves A' and B' in FIG. 3 illustrate a comparison between catholyte-cascade (curve B') and counter-current cascade (curve A'), but using an anolyte overflow of 13% NaCl, or about 75% brine conversion. Catholyte flow rate is regulated so as to attain various caustic concentrations in the catholyte effluent.

In comparing curves A and B of FIG. 2 with curves A' and B' of FIG. 3, it can be seen that the caustic efficiency, at a given caustic concentration is substantially greater with the higher NaCl anolyte concentration with the catholyte-cascade only process, but is only slightly affected by NaCl anolyte concentration in the counter-current cascade process. Caustic efficiency is also greater with the counter-current cascade than with the catholyte-cascade only. Thus it is possible to attain high conversions of brine in a series of cells by employing counter-current cascading and still attain relatively high caustic efficiencies at high caustic loadings.

EXPERIMENTAL

(FIG. 4)

FIG. 4 depicts single-cell operation (no cascading) at two levels of NaCl concentration in the anolyte overflow. Curve D illustrates results attained using an anolyte overflow concentration of 24% NaCl and Curve E illustrates an anolyte overflow concentration of 14% NaCl. At caustic concentration of about 10–12%, the curves are essentially the same, but at higher caustic concentrations, the effect of the greater NaCl concentration is seen to result in higher caustic efficiency.

The foregoing examples are for illustrative purposes and the present invention is not limited to the particular counter-current cascade embodiments shown. Anolyte concentrations may vary from about 8 to 26% NaCl and even higher if NaCl slurries are used; ordinarily, a preferred range of about 10 to 23% NaCl is employed and a brine feed at about 25–26% NaCl is used. Catholyte concentrations from the cells may be from about 5 to 50% NaOH, preferably about 10 to 30% NaOH. It will be readily appreciated by chloralkali artisans that as the catholyte flows from cell to cell, it accrues not only caustic values, but also additional water because of the electroosmotic flux (transport) of water through the membrane, even though the membrane is substantially impervious to the hydraulic transport of water. Such flux of water from the anolyte to the catholyte tends to dilute the catholyte as it accrues caustic, and tends to concentrate the anolyte as the NaCl is spent. Nevertheless, the efficiency of the process is sufficient that the intrinsic gain in caustic strength and the intrinsic depletion of anolyte strength is not seriously offset by the electroosmotic flux of water through the membrane.

We claim:

1. In the process of producing hydrogen, aqueous alkali metal hydroxide and chlorine gas by the electrolysis of aqueous alkali metal chloride solution in a bank of a plurality of membrane cells, said hydrogen and alkali metal hydroxide being produced at cathodes in catholyte portions, said chlorine being produced at anodes in anolyte portions, said membrane providing a substantially hydraulically-impermeable divider between catholyte portions and anolyte portions, the improvement which comprises flowing an aqueous alkali metal chloride as anolyte for the anolyte portions, said flowing being done in sequence from anolyte portion to anolyte portion, removing spent anolyte from the last anolyte portion of the sequence, and flowing an aqueous catholyte from catholyte portion to catholyte portion in sequence and in countercurrent manner to the anolyte flow, removing caustic-enriched catholyte from the last catholyte portion of the sequence.

2. The process of claim 1 wherein the flow of cell liquor in each electrolyte portion is in a generally upward direction.

3. The process of claim 1 wherein the anodes are dimensionally stable metal anodes comprising an electroconductive valve metal substrate having on at least a portion of its surface thereof a layer of at least one electroconductive metal oxide selected from oxides of the group of metals consisting of cobalt, rhodium, palladium, ruthenium, osmium, iridium, and platinum.

4. The process of claim 1 wherein the anodes are dimensionally stable metal anodes comprising a titanium substrate having on at least a portion of its surface thereof a layer of at least one electroconductive metal oxide selected from the group consisting of ruthenium oxide and spinels of cobalt.

5. The process of claim 1 wherein the cathodes comprise a ferrous metal.

6. The process of claim 1 wherein the cathodes comprise a ferrous metal coated on at least a portion thereof with porous nickel.

7. The process of claim 1 wherein the catholyte concentration removed from the last catholyte portion is in the range of about 5 to about 50%.

8. The process of claim 1 wherein the catholyte concentration removed from the last catholyte portion is in the range of about 10 to about 30%.

9. The process of claim 1 wherein the spent anolyte contains at least about 8% alkali metal chloride by weight.

10. The process of claim 1 wherein the spent anolyte contains at least about 8% NaCl by weight.

11. The process of claim 1 wherein the spent anolyte contains about 10 to about 23% alkali metal chloride by weight.

12. The process of claim 1 wherein the spent anolyte contains about 10 to about 23% NaCl by weight.

13. The process of claim 1 wherein the membrane comprises a hydrolyzed copolymer of tetrafluoroethylene and sulfonated perfluorovinyl ether.

* * * * *

UNITED STATES PATENT AND TRADEMARK OFFICE

CERTIFICATE OF CORRECTION

PATENT NO. : 4,273,626

DATED : June 16, 1981

INVENTOR(S) : Bobby R. Ezzell and Marius W. Sorenson

It is certified that error appears in the above—identified patent and that said Letters Patent is hereby corrected as shown below:

Col. 2, line 48, correct the word "liquid" to ---liquor---.

Signed and Sealed this

*First* Day of *December 1981*

[SEAL]

*Attest:*

GERALD J. MOSSINGHOFF

*Attesting Officer*

*Commissioner of Patents and Trademarks*